US007314143B1

(12) United States Patent
Johnson

(10) Patent No.: US 7,314,143 B1
(45) Date of Patent: Jan. 1, 2008

(54) ADJUSTABLE SHELVING SYSTEM

(75) Inventor: Bryan Thomas Johnson, Vadnais Heights, MN (US)

(73) Assignee: Innovative Tools & Technologies, Inc., St. Paul, MN (US)

( * ) Notice: Subject to any disclaimer, the term of this patent is extended or adjusted under 35 U.S.C. 154(b) by 812 days.

(21) Appl. No.: 10/727,459

(22) Filed: Dec. 3, 2003

Related U.S. Application Data

(60) Provisional application No. 60/430,516, filed on Dec. 3, 2002.

(51) Int. Cl.
*A47F 5/08* (2006.01)

(52) U.S. Cl. ..... 211/106; 211/193; 211/103

(58) Field of Classification Search .. 211/90.01–90.04, 211/207, 85.31, 106, 103, 187, 192, 191, 211/190, 193; 108/106–108, 144.11, 147.11–147.17; 248/125.3, 219.3, 224.8, 243, 245
See application file for complete search history.

(56) References Cited

U.S. PATENT DOCUMENTS 866,695 A * 9/1907 Taussig ..... 248/245
2,191,701 A * 2/1940 Wood ..... 248/245
2,997,269 A * 8/1961 Urbain et al. ..... 248/245
3,368,784 A * 2/1968 Peterson ..... 248/245
3,983,823 A * 10/1976 McDonnell ..... 108/147.11
4,469,031 A * 9/1984 Haycock ..... 108/147.17
5,180,068 A * 1/1993 Vargo ..... 211/191
5,868,263 A * 2/1999 McAllister et al. ..... 211/90.01
5,921,412 A * 7/1999 Merl ..... 211/90.03
6,712,229 B2 * 3/2004 Fritsche et al. ..... 211/189
6,726,035 B2 * 4/2004 Zadak ..... 211/90.03
6,959,824 B1 * 11/2005 Alperson ..... 211/193
2001/0045404 A1 * 11/2001 Pellegrino ..... 211/192
2004/0084392 A1 * 5/2004 Richter et al. ..... 211/59.3
2005/0145147 A1 * 7/2005 Costa et al. ..... 108/108

OTHER PUBLICATIONS

Collision Services Catalog, 2001, p. 47, 57 Back Cover , vol. 27, Hudson IA, USA.

* cited by examiner

*Primary Examiner*—Jennifer E. Novosad
(74) *Attorney, Agent, or Firm*—Mueting, Raasch & Gebhardt, P.A.

(57) ABSTRACT

An adjustable shelving storage system having support arms with a unique bracket for releasable attachment to side rail uprights.

20 Claims, 6 Drawing Sheets

ADJUSTABLE SHELVING SYSTEM

BACKGROUND

This application is a non-provisional application filed under U.S.C. §111(a) claiming priority of the provisional application Ser. No. 60/430,516 filed Dec. 3, 2002.

Numerous heavy duty shelving systems have been provided in prior art that are adapted to include rigid frames having rigid shelving. While these units may be suitable for the particular purpose to which they address, they would not be as suitable for the purposes of the present invention as hereinafter described.

SUMMARY

The present invention is directed to an adjustable shelving system that satisfies these needs for an economical, heavy-duty, adjustable shelf system for industrial, commercial, and home use that provides easy adjustment of shelving, easy storage of unused shelves, and a mobile optional. A shelving system having features of the present invention comprises a rigid shelf frame support having side rail tubes and removable support arms that may be releasably attached in pairs along both a front and back side of the side rail tubes. A pair of support arms have mounted thereon a shelf. Each support arm has a J-shaped bracket at one end thereof with a pin mounted on the bracket. One of each pair of support arms has a J-shaped bracket with a unique shaped pin. Both the pin and the shaped pin are received by one of a series of regularly placed orifices in each generally square-shaped side rail tube. The J-shaped bracket fits about three sides of the generally square-shaped side rail tube thereby firmly supporting the support arm and attached shelf once in position.

The shelf can be a flat shelf, lipped shelf, a basket or the like. In use, one of the pair of support arms having a shaped pin is inserted manually whereby the shaped pin locks into place in the side rail tube orifice and pivots therein for ease of attachment of the second support arm of the pair having a pin mounted on the bracket. This system enables the user to attach one of the pair of support arms, with the shaped pin, to the side rail and then attach the second support arm without having the first support arm fall out of place.

The side rail tubes, in actual use conditions of high carbon, heat treated steel, have spaced apart pin receiving orifices placed at regular intervals in two sides of each side rail tube enabling the shelving system to be placed on both a front and back side of the side rail tubes. In actual use conditions, the side rail tubes are generally square shaped although other shapes could be utilized. Other resilient materials could also be used.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

Understanding of the invention will be enhanced by referring to the accompanying drawings, in which like numbers refer to like parts in the several views and in which.

DETAILED DESCRIPTION OF THE CURRENTLY PREFERRED EMBODIMENTS

Understanding of the invention will be further enhanced by referring to the following illustrative but non-limiting example.

An adjustable rigid shelving storage system for use in industrial, commercial and home settings where available floor space is limited, the storage system having supports arms with a unique bracket for releasable attachment to side rail uprights whereby the support arms may be reversed for flat storage when not used. The adjustable shelving storage system is provided in wall-mounted, floor mounted and mobile versions. Additionally, a plurality of these systems may be nested together for storage thereof.

Figure 1:
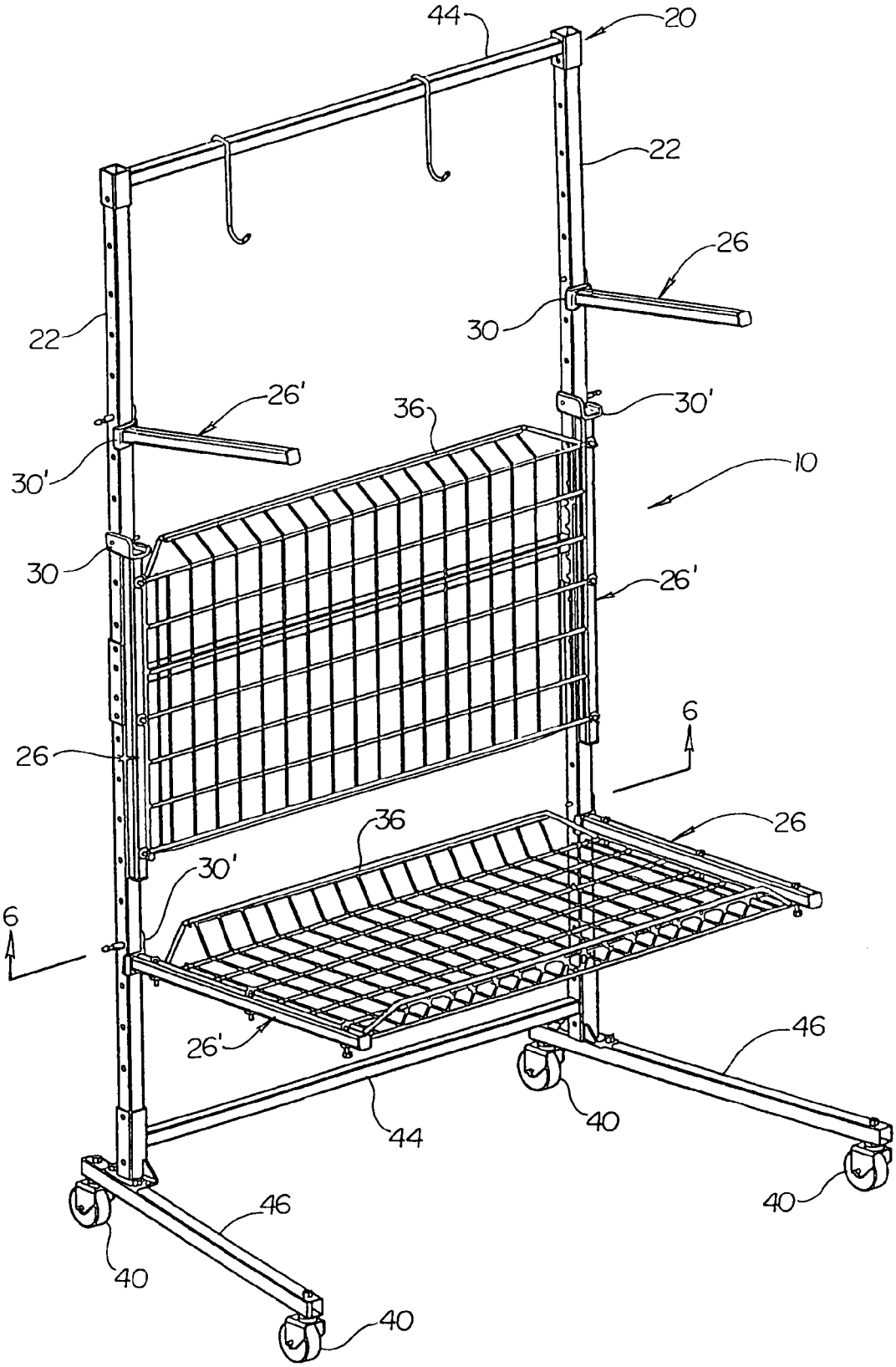
FIG. 1 is a perspective view of the optional mobile device of this invention.

Turning now to the drawings, in which like reference characters refer to corresponding elements throughout the several views, FIG. 1 illustrates the adjustable shelving system 10, from the top down, with a pair of support arms 26, 26', first without a shelf attached for ease of understanding, in a position of use extending from the side rail 22. Next is shown a pair of support arms 26, 26' with shelf 36 attached in a position of shelf storage, parallel to the side rail 22. At the bottom is illustrated pair of support arms 26 with shelf 36 attached in a position of use extending generally horizontally from the side rail 22. The side rails 22, in actual use conditions of high carbon, heat-treated generally square steel tubing, have spaced apart pin receiving orifices placed at regular intervals in two sides of each side rail 22 enabling the shelving system 10 to be placed on both a front and back side of the side rail 22. In actual use conditions, the side rail 22 are generally square shaped although other shapes could be utilized. Other resilient materials could also be used.

Figure 3:
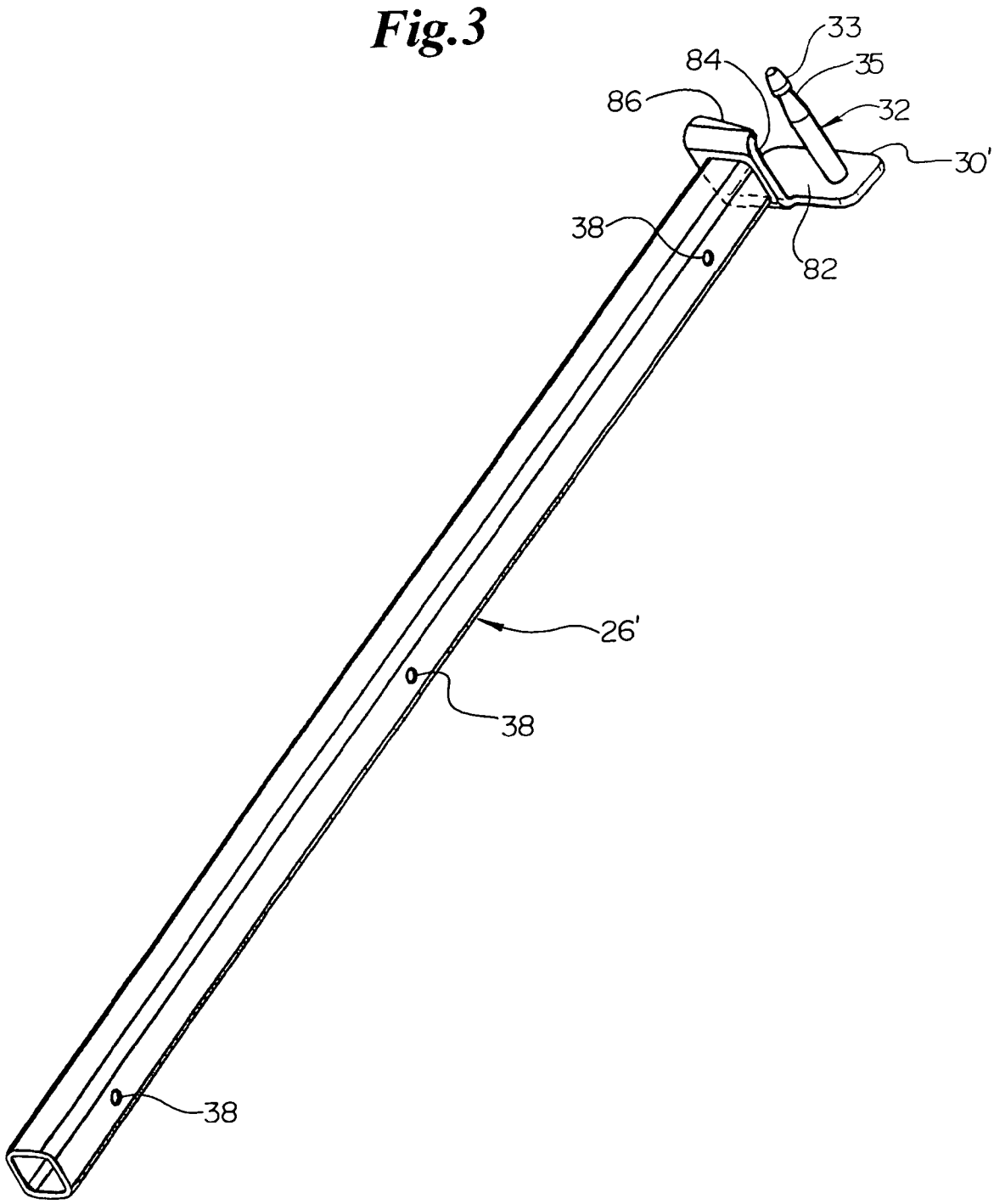
FIG. 3 is a close-up view of the support arm showing the J-shaped bracket and shaped pin.
Figure 4:
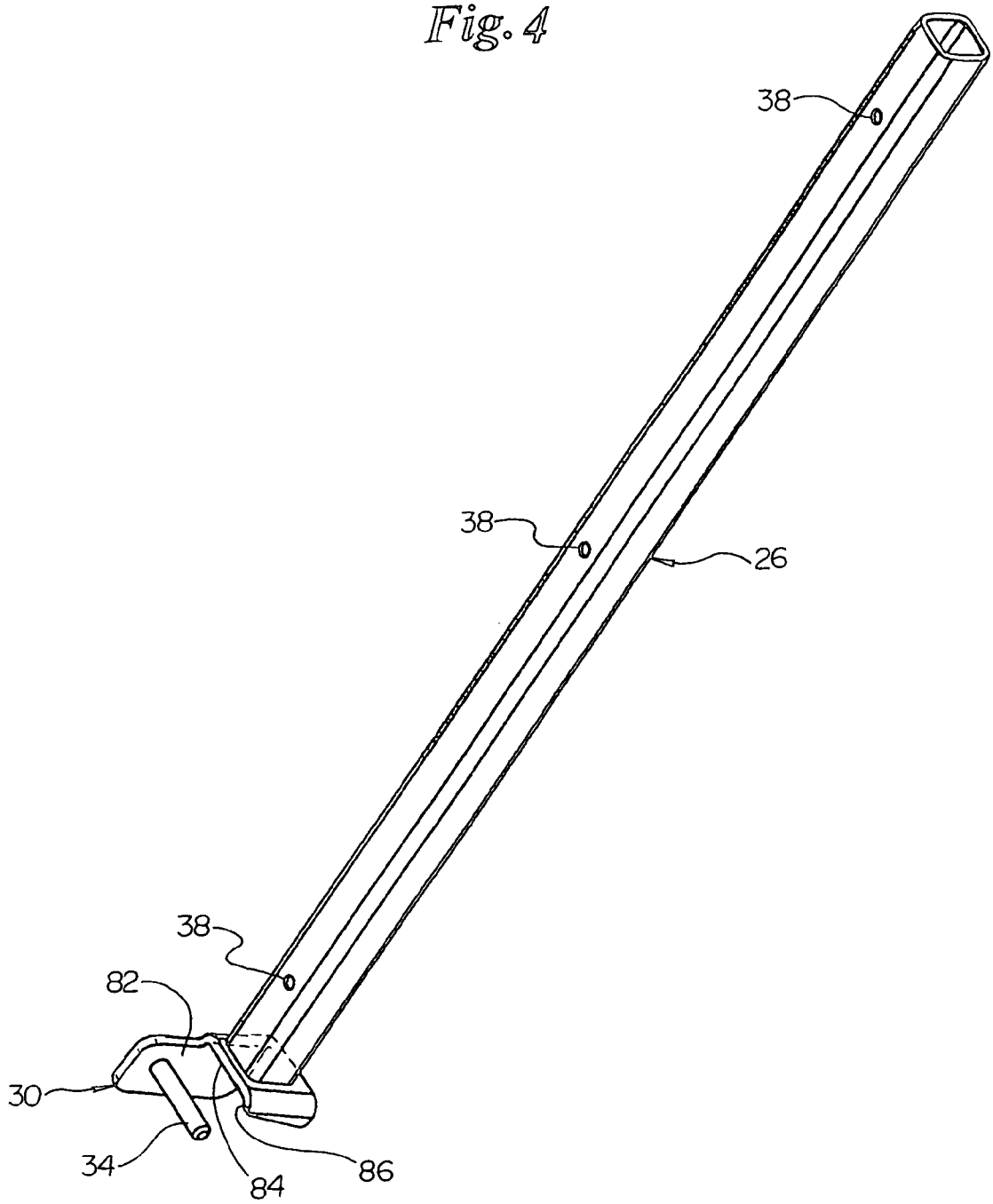
FIG. 4 is a close-up view of the support arm showing the J-shaped bracket and pin.

J-shaped bracket 30, 30' shown in detail in FIGS. 3 & 4, has three inner surfaces that wrap around the generally square-shaped side rail 22. J-shaped bracket 30', shown in detail at FIG. 3 has three inner surfaces that wrap around the generally square-shaped side rail 22. FIG. 3 illustrates J-shaped bracket 30' having a first surface 82 on which is mounted shaped pin 32, second surface 84 extending at a generally right angle from the first surface 82 and a third surface 86 extending at a generally right angle from second surface 84.

FIG. 4 illustrates J-shaped bracket 30 having a first surface 82 on which is mounted pin 30 and second surface 84 extending at a generally right angle from the first surface 82 and a third surface 86 extending at a generally right angle from second surface 84.

J-shaped bracket 30,30', shown in detail at FIGS. 3 & 4, has three inner surfaces that wrap around and lock into place about the generally square-shaped side rail 22. FIG. 3 illustrates J-shaped bracket 30' having a first surface 82 on which is mounted shaped pin 32, second surface 84 extending at a generally right angle from the first surface 82 and a third surface 86 extending at a generally right angle from second surface 84.

Attachment of J-shaped bracket 30, 30' a first at a first end 21 of each support arm 26,26', permits the support arm 26, 26' to be supported on three sides when in its position of use thereby providing a strong base of support for the support arm 26, 26'. J-shaped bracket 30, at a first end of each support arm 26,26', may be released from attachment to the side rail and reversed such that the formerly left side is attached to the right side rail, and vice versa, such that the attached shelf or the like hangs downwardly in a generally vertical, out-of-the-way position, as indicated by support arm 26 in FIG. 1. The J-shaped bracket 30 also permits the support arm 26, 26' to be adjusted upwardly and downwardly along the side rail 22. The J-shaped bracket 30 also permits the support arm 26 to be reversed, where the formerly left side bracket is attached to the right side rail 22 and vice versa, permitting out of the way storage of both the support arm 26 and the shelf 36 mounted thereon. Cross pieces 44 are shown in FIG. 1 mounted on a base 46 interconnecting and stabilizing the side rails 22 in a optional portable version having wheels 40. It is recognized that other shelves 36, such as flat, lipped, or table surface, could be used with equal success. It is also recognized that in each pair of support arms 26, 26' one of the pair has a shaped pin 32 attached to one of the pairs and a pin 34 attached to the other of each pair.

Figure 2:
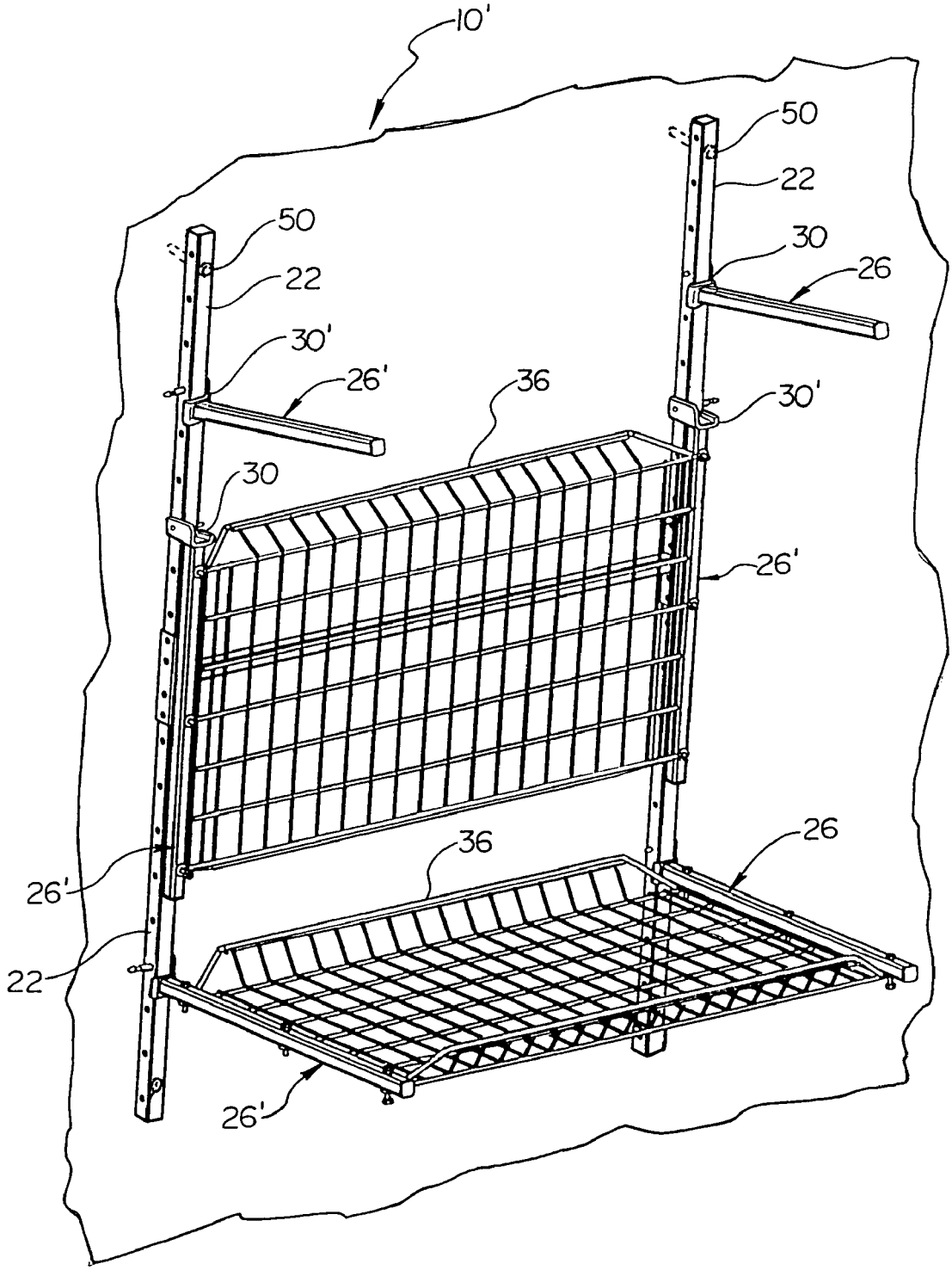
FIG. 2 is a perspective view of the wall mounted version of the device of this invention.

FIG. 2 illustrates a wall mounted system 10' with wall-mounted fasteners 50 attaching the pair of side rails 22 to a wall or other upright surface. Again, the shelf attached support arms 26, 26' are shown in a storage position and a position of use 26, 26'.

FIG. 3 shows a support arm 26' having shelf-receiving apertures 38 formed therein whereby any type of shelf could be attached. J-shaped bracket 30' is shown mounted on a first end 21 of support arm 26'. The J-shape of bracket 30' provides support to the attached support arm 26' because the J-shaped bracket 30 abuts the side rail 22 on three sides. Once the J-shaped bracket 30 is in place, it remains locked in position until such time as the user lifts up one end of the support arm 26. FIG. 3 also illustrates the shaped pin 32 which has a cap 33 that is manually pushed through a pin orifice 24 allowing the attached support arm 26, 26' to be pivoted about a neck 35 of shaped pin 32 allowing easy positioning of both of the pair of any support arms 26, 26'. Thus a first of the pair of support arms 26' is mounted on a side rail 22 and the second of the pair of support arms 26 may be positioned without the first support arm 26' falling out of position. This shaped pin 32 releasably locks into place in a pin orifice 24 in a side rail 22. This permits the basket shelf 36, or other shelf or table top, to be positioned on one side, locked into place supporting the weight of the basket and support arm 26' and then the second support arm 26 is easily positioned by placing the pin 30 of the second support arm 26 into the selected pin orifice 24 of the appropriate side rail 22.

FIG. 4 illustrates the support arm 26 with a J-shaped bracket 30 mounted on a first end 21 of support arm 26 with pin 34 shown with a tapered end 37 for ease of receipt by pin orifice 24. In use, the support arm 26' with shaped pin 32 is locked into position such that it pivots, as described above and illustrated at FIG. 3, and then the second of the pair of support arms 26 having pin 34 attached to J-shaped bracket 30 is received by the selected pin orifice 24 of side rail 22 with the pair of support arms 26, 26' supported by three-sided J-shaped bracket 30, 30' locked into place about the side rail 22 firmly supporting the weight of the basket, shelf, table top and items placed thereon.

Figure 5:
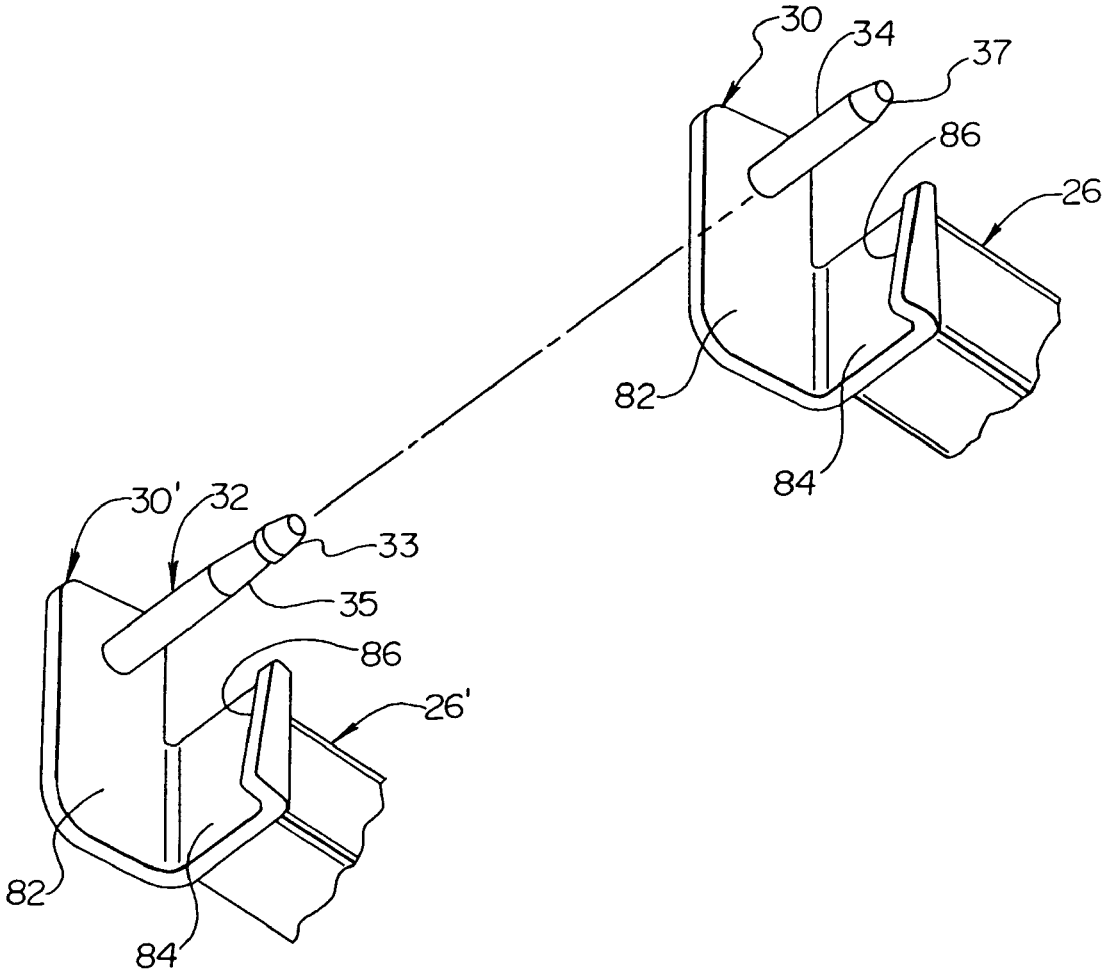
FIG. 5 is a fragmented view of the pair of support arms showing the J-shaped bracket with a shaped pin and a J-shaped bracket with a pin.

FIG. 5 illustrates a close-up view of the J-shaped bracket 30 showing how the bracket 30 receives the square-shaped side rail 22, as shown in FIG. 1, and fits about three sides of the rail 22 gaining firm support from the side rails 22. Shaped pin 32 is shown with cap 33 and neck 35 shown. Pin 34 is shown with a taper 37 to aid in receipt by pin orifice 24 as shown in FIG. 1.

Figure 6:
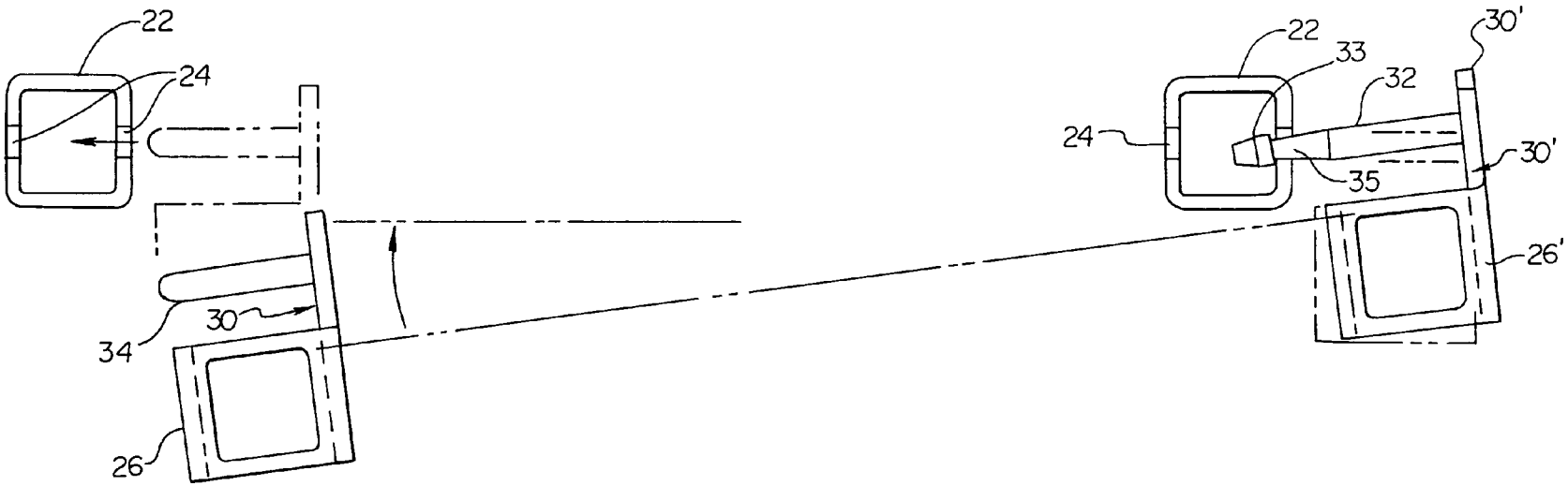
FIG. 6 is an in use cross-sectional view as indicated by arrows in FIG. 1 with the shaped pin shown received by the side rail orifice and the other pin shown in phantom about to be received by the opposite side rail orifice.

FIG. 6 illustrates how a first support arm 26' with shaped pin 32 is received by pin orifice 24 with the pin cap 33 fitting into the pin orifice 24 such that the shaped pin 32, on the bracket 30' mounted on a support arm 26', pivots about the shaped pin neck 35 allowing the attached shelf 36 mounted to the second of the pair of support arms 26 with a bracket 30 and pin 34 mounted thereon, such that the first of the pair of support arms 26' is attached and locked into place while the second support arm 26 may be positioned on the adjacent side rail 22 at the selected pin orifice 24, shown in phantom.

Adjustable shelving storage system 10 may be mounted on a base 46 with or without wheels 40 as illustrated in FIG. 1. Adjustable shelving storage system 10 may also be wall mounted, as shown in FIG. 2. Additionally, multiple adjustable shelving storage system units 10 may be nested, with the shelf baskets or other shelf or table surfaces, in the generally flat position, such that multiple adjustable shelving storage systems 10 may be place adjacent each other for storage whereby a small amount of floor space is needed to store several adjustable shelving storage systems 10. This is accomplished by removing shelf mounted support arm 26, 26' may be removed and reversed such that what was formerly on the left side rail 21 now is positioned on the right side rail and vice versa permitting flat, out-of-the way storage.

Although the present invention has been described in considerable detail with reference to certain preferred versions thereof, other versions are possible. For example, a combination of these systems may be used in a setting where shelf storage is needed, such as a garage, display area, and industrial areas.

Changes and modifications in the specifically described embodiments can be carried out without departing from the scope of the invention.

I claim:

1. An adjustable shelving system comprising:

a side rail comprising at least one orifice extending through the side rail from a first side surface thereof to a second side surface thereof;

a support arm extending between a first end and a second end, wherein the second end is attachable to the side rail;

a locking bracket at the second end of the support arm comprising at least one inner surface configured to wrap around at least a portion of the side rail when the support arm is attached to the side rail; and a pin extending from the at least one inner surface of the locking bracket orthogonal to the support arm, wherein the pin is sized as a function of the at least one orifice such that it extends through the first side surface and second side surface of the side rail when the support arm is attached to the side rail.

2. The adjustable shelving system according to claim 1, wherein the locking bracket maintains the pin through the first side surface and second side surface of the side rail when the support arm is attached to the side rail.

3. The adjustable shelving system according to claim 1, wherein the pin extending from the at least one inner surface terminates at a cap portion with a neck portion adjacent the cap portion, wherein the neck portion has a smaller cross-section than the cap portion.

4. The adjustable shelving system according to claim 1, wherein the side rail is tubular.

5. The adjustable shelving system according to claim 1, wherein the side rail has a square cross-section.

6. The adjustable shelving system according to claim 1, wherein the pin is located a distance away from the support arm and in a plane parallel thereto.

7. The adjustable shelving system according to claim 1, wherein the at least one inner surface of the locking bracket comprises:

a first inner surface from which the pin extends; and a second inner surface parallel to the first inner surface.

8. The adjustable shelving system according to claim 1, wherein an edge of the second inner surface is angled, such that when the support arm is attached to the side rail, a user may lift up on the first end of the support arm to allow release of the pin from the orifice of the side rail.

9. The adjustable shelving system according to claim 1, wherein the adjustable shelving system further comprises at least one additional side rail, at least one additional support arm, and at least one shelf supported by the support arms.

10. An adjustable shelving system comprising:

a side rail having four sides, wherein the side rail comprises at least one orifice extending through the side rail from a first side surface of the four sides to a second side surface of the four sides, and wherein the first side surface is opposite the second side surface;

a support arm, wherein the support arm extends between a first end and a second end, wherein the second end is attachable to the side rail;

a J-shaped bracket at the second end of the support arm comprising at least one inner surface configured to wrap around at least a portion of three sides of the side rail when the support arm is attached to the side rail, wherein the inner surface comprises a first inner surface, a second inner surface extending orthogonally from the first inner surface, and a third inner surface extending orthogonally from the second inner surface and parallel to the first inner surface; and a pin extending from the first inner surface of the J-shaped bracket orthogonal to the support arm, wherein the pin is sized as a function of the at least one orifice such that it extends through the first side surface and second side surface of the side rail when the support arm is attached to the side rail.

11. The adjustable shelving system according to claim 10, wherein the J-shaped bracket maintains the pin through the first side surface and second side surface of the side rail when the support arm is attached to the side rail.

12. The adjustable shelving system according to claim 10, wherein the pin extending from the first inner surface terminates at a cap portion with a neck portion adjacent the cap portion, wherein the neck portion has a smaller cross-section than the cap portion.

13. The adjustable shelving system according to claim 10, wherein the pin is located a distance away from the support arm and in a plane parallel thereto.

14. The adjustable shelving system according to claim 10, wherein the adjustable shelving system further comprises at least one additional side rail, at least one additional support arm, and at least one shelf supported by the support arms.

15. An adjustable shelving system comprising:

a first side rail and a second side rail, wherein each side rail comprises at least one orifice extending through each side rail from a first side surface thereof to a second side surface thereof;

a first support arm and a second support arm, wherein each support arm extends between a first end and a second end, wherein the second end is attachable to either the first or the second side rail;

a locking bracket at the second end of each of the first and second support arms comprising at least one inner surface configured to wrap around at least a portion of the side rail when the support arm is attached to the side rail;

a pin extending from the at least one inner surface of each of the locking brackets orthogonal to the support arm, wherein the pin is sized as a function of the at least one orifice such that it extends through the first side surface and second side surface of the side rail when the support arm is attached to the side rail; and at least one shelf supported by the first and second support arm.

16. The adjustable shelving system according to claim 15, wherein the pin extending from the at least one inner surface of the first support arm terminates at a cap portion with a neck portion adjacent the cap portion, wherein the neck portion has a smaller cross-section than the cap portion.

17. The adjustable shelving system according to claim 15, wherein the pin of the first support arm is longer than the pin of the second support arm.

18. The adjustable shelving system according to claim 15, wherein the pin of the first support arm and the pin of the second support arm have the same axis when the at least one shelf is supported thereby.

19. The adjustable shelving system according to claim 15, wherein the locking bracket maintains the pin through the first side surface and second side surface of the side rail when the support arm is attached to the side rail.

20. The adjustable shelving system according to claim 15, wherein each pin is located a distance away from the first and second support arms and in a plane parallel thereto.

* * * * *

UNITED STATES PATENT AND TRADEMARK OFFICE

CERTIFICATE OF CORRECTION

PATENT NO. : 7,314,143 B1
APPLICATION NO. : 10/727459
DATED : January 1, 2008
INVENTOR(S) : Bryan Thomas Johnson It is certified that error appears in the above-identified patent and that said Letters Patent is hereby corrected as shown below:

In column 2, line 23 delete “supports” and insert --support--;

In column 2, line 27, delete “floor mounted” and insert --floor-mounted--;

In column 2, line 63, delete “30,30'” and insert --30, 30'--;

In column 3, line 4, delete first occurrence of “a first”;

In column 3, line 5, delete “21”;

In column 3, line 9, delete “26,26'” and insert --26, 26'--;

In column 3, line 33, bold --26, 26'--;

In column 3, line 59, delete “21”;

In column 4, line 21, bold “FIG.”;

In column 4, line 32, delete “21”;

In column 5, line 16, claim 8, delete “claim 1” and insert --claim 7--.

Signed and Sealed this

Twenty-ninth Day of July, 2008

JON W. DUDAS
*Director of the United States Patent and Trademark Office*